US005240372A

United States Patent [19]

Krienke

[11] Patent Number: 5,240,372

[45] Date of Patent: Aug. 31, 1993

[54] CENTRIFUGAL PUMPS AND SYSTEMS UTILIZING SAME

[76] Inventor: Heinz H. Krienke, 1130 Thornton Ave., Plainfield, N.J. 07060

[21] Appl. No.: 906,443

[22] Filed: Jun. 30, 1992

[51] Int. Cl.[5] ..... F04D 1/00; F04D 29/18

[52] U.S. Cl. ..... 415/71; 415/92; 415/116; 416/181; 416/183

[58] Field of Search ..... 415/71, 92, 116; 416/235, 181, 183

[56] References Cited

U.S. PATENT DOCUMENTS

| | | | |
|---|---|---|---|
| 1,077,520 | 11/1913 | Gentil | 415/116 |
| 3,663,117 | 5/1972 | Warren | 415/116 |
| 3,907,456 | 9/1975 | Krienke | 415/71 |
| 4,586,877 | 5/1986 | Wantanabe et al. | 415/55.1 |
| 4,776,758 | 10/1988 | Gullichsen | 415/169.1 |
| 5,039,320 | 8/1991 | Hoglund et al. | 415/169.1 |
| 5,137,418 | 8/1992 | Sieghartner | 415/55.1 |

FOREIGN PATENT DOCUMENTS

| | | | |
|---|---|---|---|
| 156620 | 9/1982 | German Democratic Rep. | 415/116 |
| 45 | of 1912 | United Kingdom | 415/76 |
| 387766 | 2/1933 | United Kingdom | 415/76 |

*Primary Examiner*—Edward K. Look
*Assistant Examiner*—Michael S. Lee
*Attorney, Agent, or Firm*—John N. Bain; John D. Kaufmann; Raymond J. Lillie

[57] ABSTRACT

A centrifugal pump for a first fluid has a housing with an inlet and includes a rotatable impeller which is adjacent to a stationary plate. The inlet communicates with a space defied between the impeller and the plate. An outlet adjacent to the periphery of the impeller also communicates with the space. The space is divided into a plurality of zig-zag pumping passages which extend from the inlet to the periphery of the impeller. Each passage has undulating sidewalls defined by complementary undulations in the facing surfaces of the plate and the impeller. Each passage also has endwalls defined by vanes mounted to the impeller. The vanes generally conform to the undulations in the impeller and are also complementary to the undulations in the plate. An injection port in the plate communicates with the space downstream of the inlet at a point where the lowest absolute pressure within the passages exists. A second fluid may be injected through the port and into the passages. The vapor phase of the first fluid, which is present in the passages because of the low absolute pressure, is condensed and compressed upon contact with the second fluid and is thereafter centrifugally moved to the outlet. Depressions downstream of each pressed in the undulating surfaces of both the plate and the impeller encourage the establishment of vortices therein, the vortices encouraging and expediting fluid flow along the passages.

18 Claims, 3 Drawing Sheets

CENTRIFUGAL PUMPS AND SYSTEMS UTILIZING SAME

BACKGROUND OF THE INVENTION

This invention relates to improved centrifugal pumps and to systems using such pumps.

More particularly, the present invention relates to the type of centrifugal pump that includes an impeller or rotor which is rotated in moderately close proximity to a stationary plate or stator. The stationary plate has a central, coaxial inlet through which liquid passes and is thereafter conveyed by centrifugal force along the impeller-plate spacing to an outlet at the periphery of the impeller and the plate.

One type of centrifugal pump as described immediately above is shown and claimed in U.S. Pat. No. 3,907,456 issued to the inventor hereof. In the '456 patent, pumping efficiency is improved by creating complementary sinuous surfaces on the impeller and the plate. The impeller may carry sinuous vanes complementary to both surfaces which radiate outwardly to the impeller's periphery and define flow passages therebetween.

The pump of the '456 patent itself was an improvement of earlier centrifugal pumps which typically included very close spacing between the impeller and the plate. Prior to '456 patent the surfaces of both the impeller and the plate had typically been smooth. Prior art centrifugal pumps are shown in the following U.S. Pat. Nos. 1,013,248; 1,383,937; 2,569,563, 2,737,898; and 2,780,176.

The pump of the '456 Patent permits efficient pumping operation while producing an extremely low absolute pressure at the inlet. Indeed, the centrifugal pump of the '456 Patent is capable of pumping gasses or vapors as well as liquids, and, thus, is a true fluid (liquid and/or gas) pump.

A primary object of the present invention is to further improve the pump of the '456 Patent by improving its performance characteristics and also, to provide for a modification of the pump of the '456 Patent to permit it to be used in a novel fashion to achieve hitherto unrealized results including the desalinization of sea water, and the production of water-oil emulsions for combustion in oil furnaces or the like and de-gassification of liquids.

SUMMARY

With the above and other objects in view, the present invention relates to an improved centrifugal pump. The pump is of the type which includes a housing having an inlet, and an impeller which is rotatable within the housing adjacent to a stationary plate. A space is defined between the impeller and the plate. The inlet is generally coaxial with the axis of rotation of the impeller and communicates with the space. A drive facility rotates the impeller. An outlet is located in the housing at the periphery of the impeller The space is divided into a plurality of pumping passages which are spaced apart circumferentially of the impeller and extend from the inlet to the outlet. Each passage has undulating sidewalls defined by complementary undulations formed in the facing surfaces of the plate and the impeller. Each passage also includes vanes mounted to the impeller which radiate outwardly from the inlet to the outlet. These vanes generally conform to the undulations in the impeller and are complementary to the undulations in the plate. The foregoing covers the prior art centrifugal pump depicted in the '456 Patent which is improved hereby.

In a first aspect, the improved pump of the present invention includes one or more injection ports formed through the plate and terminating at a point slightly downstream of the inlet whereat there exists the lowest absolute pressure within the passage. This point has been found to be just downstream of the first peak downstream of the inlet in the undulating surface of the plate. Facilities are provided to inject through the injection port and into the passage a first liquid having a lower temperature than that of a second liquid (and its vapor phase) which is being drawn into the inlet and pumped out of the outlet. The high vacuum at the injection point produces a vapor bubble or ring of the second liquid thereat or further upstream. The injected first liquid condenses the vapor of the second liquid, the two fluids being thereafter centrifugally pumped and moved together to the outlet.

One use for the improved pump of the present invention in its first aspect is in a system which includes both the improved pump and the pump of the '456 patent. The latter pump is connected to a sealed or closed reservoir holding a liquid such as sea water or salt water. The pump is operated to pump the liquid out of the reservoir to thereby produce a reduced absolute pressure above the liquid level of the salt water. Pumping continues for a sufficient time until a significant amount of water vapor is present in the reservoir above the falling liquid level. This mode of operation is possible because the pump of the '456 patent is capable of efficiently pumping liquids. The improved pump is then used to pump the water vapor from the reservoir. This water vapor is condensed in the manner described above by the injection of cooler water through the injection port of the pump. Since the water vapor in the reservoir contains no sodium chloride, the foregoing described system comprises an effective desalinization system If the improved pump is used to pump oil, and if water is injected via the injection port, a high quality, stable water-oil emulsion is formed which has long life and provides an efficient combustion medium to be burned in a furnace, burner or the like.

The improved pumping may also be used to degassify liquids. to degassify water—for example, to remove dissolved hydrogen, oxygen and nitrogen—the water is pulled into the inlet by the pump via a trap. Because of the low absolute pressures of the pump inlet and, accordingly, in the trap, dissolved gasses are extracted or pulled out of the water before the water is vaporized. The extracted gases which collect in the trap are fed from the trap to the injection port where they are mixed with the water and fed from the pump outlet to a holding tank. The gases rise to the top of the water and dissipate into the atmosphere. Because a very low absolute pressure is required to extract the dissolved gases, a very high pressure is required to redissolve the gases in the water. The pressure within the pump is not sufficiently high to redissolve the gases, which are merely mixed with the water and are easily dissipated from the water.

In a second aspect of the present invention, one or more depressions are formed downstream of each peak in the undulating surfaces of the plate and the impeller. These depressions accommodate and encourage the formation of vapor vortices which tend to form in these areas due to the low absolute pressure within the pump. Further, the troughs of both undulating surfaces are rounded or formed with radii to establish and accommodate the formation of vortices thereat. The vortices that are established at or near the peaks and troughs rotate about an axis which is perpendicular to the flow of fluid through the passages. The vortices rotate where they are tangential to the path of liquid flow in the same direction as such liquid flow. The vortices thus act as effective "vapor bearings" for fluid flow, thereby improving the efficiency of the pump.

DETAILED DESCRIPTION OF THE INVENTION

Figure 2:
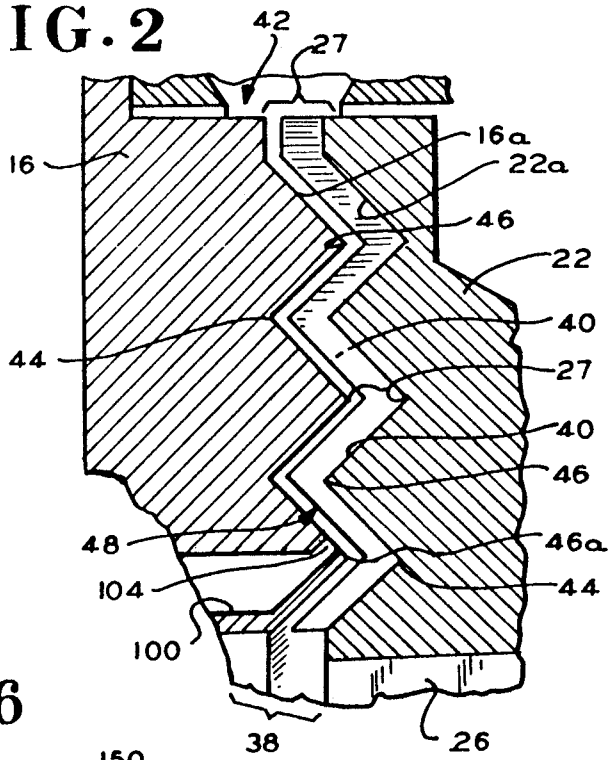
FIG. 2 is an enlarged view of a portion of the pump of FIG. 1 illustrating in greater detail the structure thereof.
Figure 1:
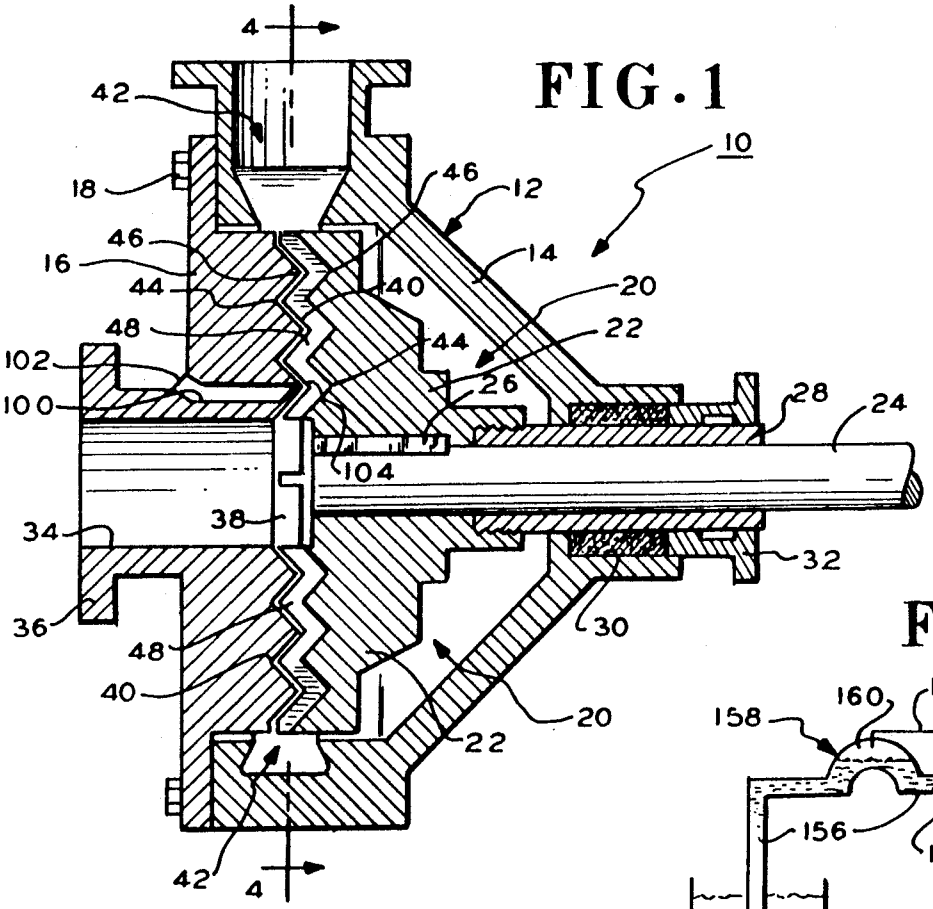
FIG. 1 is a schematic sectional view of a pump according to the principles of the present invention.

Referring first to FIGS. 1 and 2, a centrifugal pump 10, according to the present invention, includes a housing 12 having a forward section 14 and a rearward, stationary end plate section or stator 16. The sections 14 and 16 are secured together by cap screws 18 or other fasteners to define therebetween a pumping chamber 20. An impeller 22 is fixed to a drive shaft 24 by means of a key 26 to rotate within the pumping chamber 22. During such rotation, the facing, relatively moving surfaces of the plate 16 and the impeller 22 are and remain separated by a moderately close space or gap 27. The drive shaft 24 may be journaled for rotation in the forward section 14 in any standard fashion, for example, by means of a bushing 28 journaled in a packed bearing 30 having a gland 32, all of known construction.

Formed integrally with or mounted to the end plate 16 is an inlet conduit 34 which may be flanged as at 36 to facilitate connection to a fluid supply line (not shown). The conduit 34 communicates with an inlet opening 38 through the plate 16 which communicates with the chamber 20 and the space 27 between the plate 16 and the impeller 22. The inlet opening 38 is defined between the plate 16 and the impeller 22 by appropriate shaping thereof.

Located in the space 27 and radiating from and communicating with the inlet opening 38 are a plurality of zig-zag pumping passages 40 (see also FIG. 4) that are spaced circumferentially about the impeller 22 and extend outwardly from the inlet opening 38 to the outer periphery of the impeller 22. The passages 40 communicate with and discharge fluid into an outlet 42 which may be formed in the housing 14.

The passages 40 are partly defined by and between side walls which constitute complementary undulations formed in the facing surfaces **16*a* and 22*a* of the plate 16 and the impeller 22. As shown in FIGS. 1 and 2, these undulations 16*a* and 22*a* may take the form of periodically recurring troughs 44 and crests 46 in the surfaces 16*a* and 22*a* of the plate 16 and the impeller 22. The undulations in the facing surfaces 16*a* and 22*a* are complementary so that, for example, a crest 46 of the undulating surface 22*a* of the impeller 22 is adjacent to a trough 44 in the surface 16*a* of the plate 16. The passages 40 are also defined in part by vanes 48 which constitute end walls. The vanes 48 are complementary to the undulating surface 16*a* of the plate 16 and follow the undulations of the impeller 22. The vanes 48 are mounted in any convenient fashion to the impeller 22 for rotation therewith. The vanes 48, as shown, complementarily follow and fit into the undulating surface 22*a* of the impeller 22 so as to be closely spaced from the complementary undulating surface 16*a* of the plate 16 when the impeller 22 rotates. The vanes 48 have troughs 44*v* and crests 46*v* which mimic those of the impeller 22**.

As discussed in the commonly owned '456 patent and as shown in FIGS. 3–11 thereof, the undulating surfaces and the vanes 48 may take numerous other configurations which may differ from those depicted in the Figures hereof In any event, the passages 40 rotate in the space 27 with the impeller 22. That is, the sidewall **22*a* and the vanes or end walls 48 of the impeller 22 rotate with the impeller 22, while the sidewall 16*a* remains stationary with the plate 16**.

As thus far described, the centrifugal pump 10 is generally similar to that described in the commonly owned '456 patent. According to the improvement of the present invention, there is provided in the plate 16 an injection port or injector 100 (FIGS. 1 and 2). The injector 100 has an entrance 102 and an exit 104 through which a fluid may flow. To that end, the entrance 102 may be so formed in the plate 16 as to be provided with facilities (not shown) to facilitate coupling to a source of fluid (not shown). The exit 104 is formed in the plate 16 to inject fluid into the space 27 and into the passages 40 as they rotate therepast, at the point whereat the lowest absolute pressure exists during operation. Typically, the point of lowest absolute pressure has been found to be just slightly downstream of the first crest **46*a* of the undulating surface 16*a* of the plate 16 (FIG. 2). During typical atmospheric pressure conditions, a low absolute pressure at the inlet 38 has been measured at about 29 inches Hg, and the low absolute pressure at the first crest 46*a*** has been measured at about 29½ inches of mercury.

Figure 4:
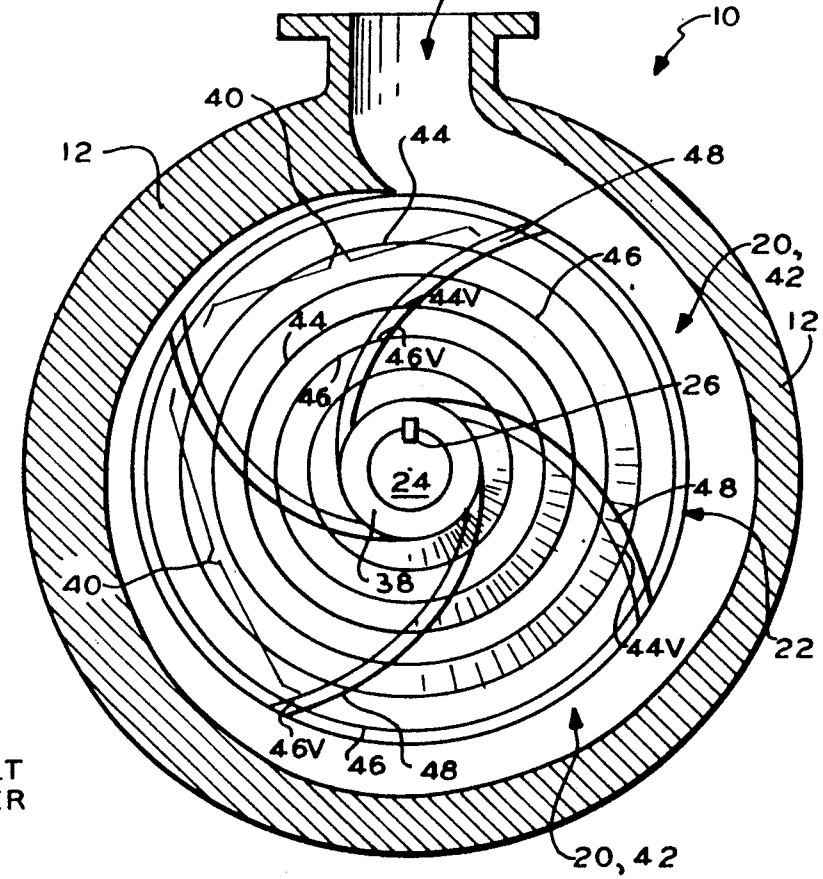
FIG. 4 is a transverse sectional view taken along line 4—4 of FIG. 1.

Preferably, the axis of the exit 104 is generally perpendicular to that portion of the undulating surface **16*a* of the plate 16 through which it communicates with the space 27 and the passages 40. The size and location of the exit 104 may vary according to design conditions, as may the number of injectors 100 used. For example, as shown in FIG. 4, the four vanes 48 divide the impeller 22 into four rotating passages 40. In this event, there may be four injectors 100 formed in the plate 16 90° away from each other. These injectors may have exits 104 which are round holes or arcuate, elliptical slots. Additional injectors 100 may have exits 014 midway between the initial injectors 100**.

In use of the pump 10, a first fluid such as water, water vapor or oil is passed through the inlet 34, 38 and the fluid is then centrifugally pumped to the outlet 42 as described in the '456 patent. The pump 10 is operated in such a fashion that the fluid drawn into the inlet 34, 38 and entering the space 27 and the passages 40 is subjected to a pressure lower than its vapor pressure at the point 46a of maximum negative pressure (and at the inlet 34, 38). A second fluid such as water is passed through the injector 100. This second fluid has a lower temperature than the first fluid so that when it contacts the vaporized first fluid at the point 46a, the first fluid is condensed and the mixture is moved by the pump 10 along the passages 40 to the outlet 42.

The pump 10 so far described is basically the pump of the '456 Patent modified by the addition of the injector 100 thereto. As set forth in the '456 Patent, the pump 10 has the ability to apply a very low absolute pressure to the inlet 34, 38. Indeed, as noted above, the lowest absolute pressure will be applied to the fluid at or near the first crest 46a of the undulating surface 16a of the plate 16. Absolute pressure at the inlet 34, 38 of pumps 10 constructed in accordance with the '456 Patent has been measured at 29½" Hg. Studies have confirmed not only the ability of the pump 10 to produce such low absolute pressures but also the ability of the pump 10 to pump both liquids and gases, that is, fluids of any kind. Further, the low absolute pressure within the pump produces vapor bubbles or rings of the fluid being pumped at numerous sites, typically at or near each crest 46 and trough 44. These bubbles/rings do not collapse and cavitation damage accordingly does not occur.

Figure 5:
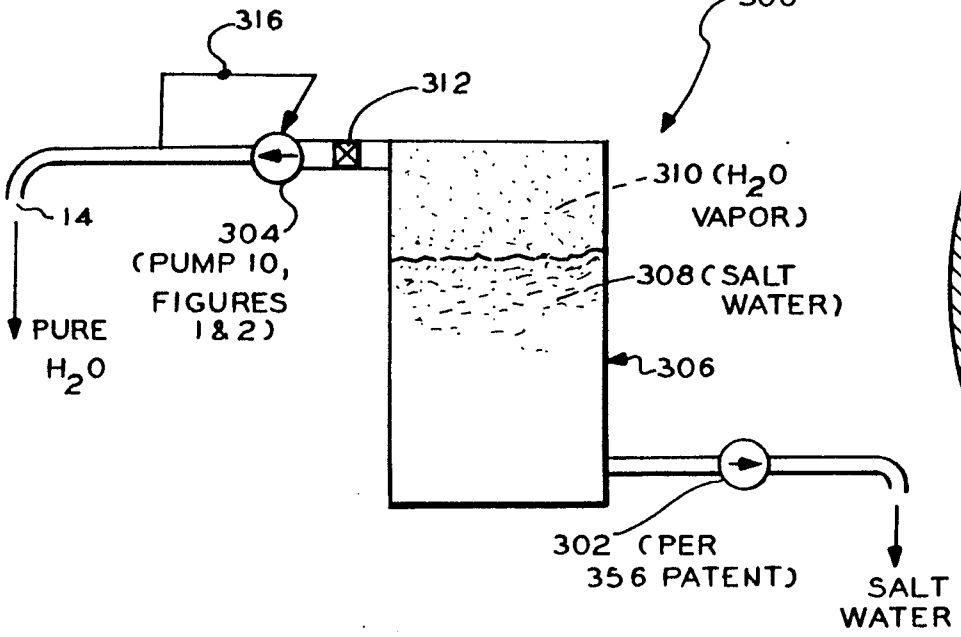
FIG. 5 is a schematic view of a system utilizing a pump in accordance with the present invention for the desalinization of salt water or sea water.

Referring now to FIG. 5, there is shown a system 300 for desalinizing salt water or sea water. The system 300 includes two pumps 302 and 304. The pump 302 may take the form of the pump described in the '456 patent. The inlet of the pump 302 is connected to a closed reservoir 306 which contains a body 308 of salt water. The inlet of the pump 302 is connected with the reservoir 306 below the level of the salt water 308. The pump 302 is operated to remove the water 308. This ultimately creates a high density of water vapor above the lowering level of the salt water 308 within the closed reservoir 306. In effect, the pump 302 forces the water portion of the salt water 308 to evaporate or to "boil" within the closed reservoir 306. Thus, above the mass of salt water 308, there ultimately is present a high density mass 310 of water vapor. The pump 304 is constructed like the pump 10 of FIG. 1, that is, it contains the injector 100. The inlet of the pump 304 is connected to the reservoir 306 so as to be capable of pumping from the reservoir 306 the water vapor 310. A normally closed valve 312 is selectively opened to permit the pump 304 to remove the water vapor 310 when a sufficient density thereof is available. As the pump 304 operates, cool water is supplied to the injector 100. This cool water causes the water vapor 310 to condense. The mixture of injected water and condensed water exits the pump 304 as shown at 314 for utilization. Some of the water is recycled back to the injector 100 for further condensation of water vapor 310 as shown by the path 316.

The pump of the '456 Patent and the present pump 10 have been observed to be able to withstand the rings or bubbles of vapor which are created during the centrifugal pumping, as well as those which exist when vapor is being pumped. For reasons not fully understood, internally of the pump 10 vapor pockets form which may change in size but do not collapse. As a consequence, cavitation damage to the pump is minimal, if not, nonexistent.

Another use to which the pump 10 of FIG. 1 can be put is the formation of fuel oil/water emulsions for the more efficient burning of the fuel oil. It has been found that using the pump 10 to pump a fuel oil will produce a very low absolute pressure which vaporizes fuel oil at the point 26a. The injection of cold water through the injector 100 condenses the fuel oil and causes the water to be thoroughly and completely incorporated into the fuel oil. The fuel oil/water emulsion thereby formed is highly stable and does not separate into its component parts for a substantial period of time. Accordingly, the pump 10 may be used to form the emulsion for later use or, if convenient, may be located close to the burner jets or burner nozzles of a furnace or the like for combustion of the emulsion immediately after its formation.

Figure 6:
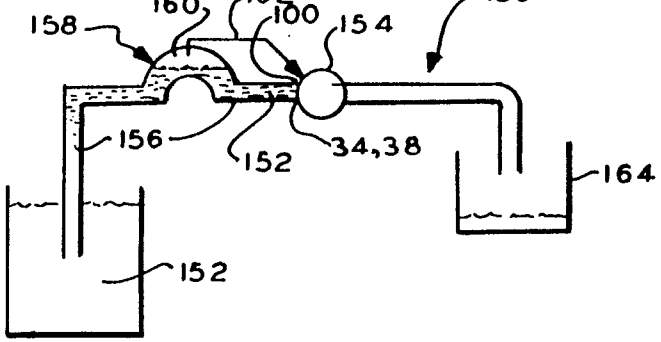
FIG. 6 is a schematic view of a system utilizing the pump of the present invention for degassifying liquids.

Referring to FIG. 6, a system 150 for degassifying a liquid 152 such as water is shown. The liquid 152 containing dissolved gases, such as oxygen, hydrogen and nitrogen, is pulled by a pump 154, which is the same as the pump 10 in FIG. 1, through a conduit 156 connected to the inlet 34, 38. A trap 158 in the conduit traps and holds gasses 160 which are extracted from the liquid 152 as a result of the low absolute pressure at the inlet 34, 38. The gases 160 are conveniently removed by connecting the trap 158 to the injector 100 with a conduit 162 so that the extracted gases 160 are mixed with, but not redissolved in, the liquid 152 in the pump 154. The liquid/gas 152/160 mixture may be fed to a holding tank 164 whereat the gases 160 dissipate into the atmosphere. There is no absolute pressure within the pump 154 sufficiently high to redissolve the gas 160 in the liquid 152, in the dissolved gas 160 having been extracted by the very low absolute pressure at the inlet 34, 38.

In a further embodiment of the present invention, an improvement is provided to facilitate the establishment of vortices in the liquid flowing through the passages 40 to thereby increase the overall efficiency of the pump 10 and to reduce damaging effects of bubble collapse on the elements of the pump 10.

Figure 3:
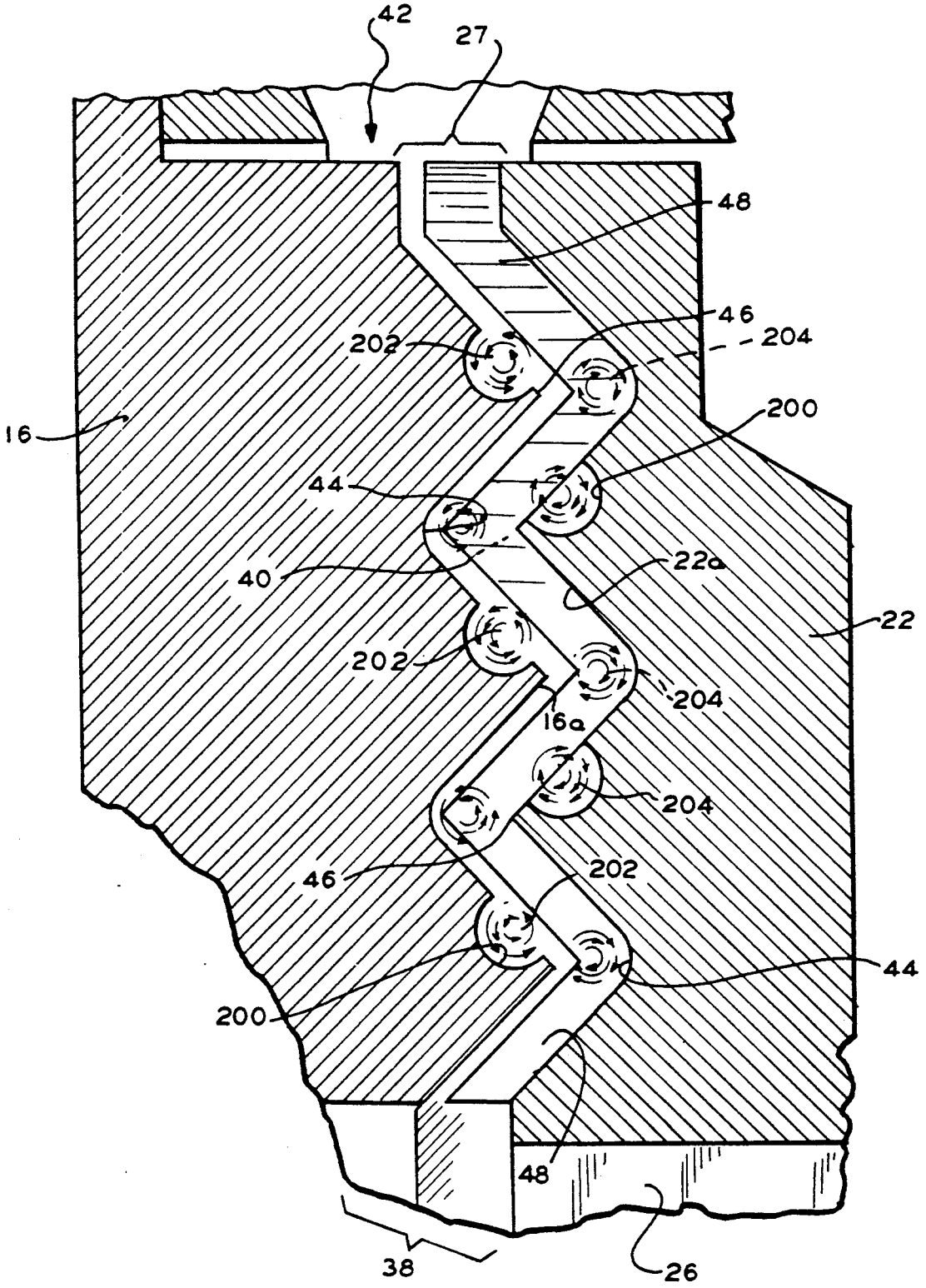
FIG. 3 is a view similar to FIG. 2 depicting an enlargement of a portion of the pump of FIG. 1 with the addition, however, of structural features which improve the efficiency of the pump of FIG. 1.

Referring to FIG. 3, it may be seen that just downstream of the crests 46 of the undulating surfaces of both the plate 16 and the impeller 22, there are formed small depressions or pockets 200. It has been found that these depressions 200 facilitate the establishment of vortices 202 and 204 and accommodate those vortices 202, 204 which are formed. The vortices 202, 204 are typically low pressure regions of vapor. To compliment the depressions and their function, the radii of the troughs 44 in the undulating surfaces 16a and 22a of both the plate 16 and the impeller 22 are selected so that the bottom of the troughs 44 are smooth. It has been found that vortices 202, 204 which are created and which are located at or near the crests 46 and troughs 44 as a result of the foregoing, rotate in the direction of the flow of the liquid through the passage 40, that is, with their axis of rotation perpendicular to the plane of FIG. 3 and with the portion of each vortex 202, 204 adjacent to the fluid stream moving in the same direction as such stream.

As discussed previously, the flow path through the pump 10 in both '456 Patent and in the present invention is a zig zag flow path. Tests have been conducted in which the metal plate 16 has been replaced by a transparent Plexiglas plate for purposes of observation of conditions within the pump 10. These observations indicate that rings or partial rings of vapor are established during operation of the pump 10 at transitions (i.e., the troughs 44 and the crests 46) in the undulating surfaces of the plate 16 and the rotor 22. The rings have been observed to expand and contract as the outlet pressure varies. The rings have also been observed, however, to not collapse during operation of the pump 10. This lack of collapse of the rings (which may be viewed as large bubbles) leads to a lack of cavitation damage of the surfaces of the pump 10. It is theorized that because the rings or bubbles do not collapse, the pump 10 may, in effect, operate without damage under what would otherwise constitute cavitation conditions. It is postulated that the vapor rings or bubbles are actually vapor vortices that expand and contract with the variable conditions of turbulent flow. The pump 10 of the present invention as depicted by the embodiment in FIG. 3 encourages the formation of these vortices to improve the performance characteristics of the pump 10. Another theory assumes that the intentionally encouraged vortices act as vapor bearings for the fluid flowing through the pump thereby increasing throughput.

In the prior art, it is normal to design centrifugal pumps in such a way that bubbles or vapor pockets or rings are avoided and are not created in order to avoid a vibration, cavitational damage and vapor lock. Thus, the present invention runs counter to the prior art in intentionally encouraging the formation of vortices in order to increase the efficiency and throughput of the pump 10.

Those having skill in the art will appreciate the various modifications and changes that can be made to the above-described pump 10 without departing from the spirit and scope of the following claims.

I claim:

1. An improved centrifugal pump for pumping a first fluid, the pump being of the type having a housing with an inlet and impeller which is rotatable within the housing adjacent to a stationary plate, the impeller and plate defining a space therebetween with which the inlet communicates, an outlet in the housing which is adjacent the periphery of the impeller and communicates with the space, the space being divided into a plurality of zig-zag pumping passages spaced circumferentially of the impeller and extending from the inlet to the periphery of the impeller, each passage having undulating side walls defined by complementary undulations formed in the facing surfaces of the plate and the impeller, each passage also having end walls defined by vanes mounted to the impeller which vanes extend outwardly from the inlet to the impeller periphery, generally conform to the undulations in the impeller and are complementary to the undulations in the plate, wherein the improvement comprises:

an injection port in the plate which communicates with the space downstream of the inlet at a point whereat there exists the lowest absolute pressure within the passages, and means for injecting through the port and into the passages a second fluid, whereby the vapor phase of the first fluid which is present in the passages because of the low absolute pressure is condensed and compressed upon contact with the second fluid and is thereafter centrifugally moved to the outlet.

2. An improved centrifugal pump as in claim 1, wherein:

the point at which the lowest absolute pressure exists is slightly downstream of the first crest of the undulating surface of the plate.

3. An improved centrifugal pump as in claim 2, wherein:

the axis of the injection port is generally perpendicular to the plane of that portion of the undulating surface of the plate just downstream of the first crest.

4. An improved centrifugal pump as in claim 3, wherein:

a plurality of injection ports are in the plate and are spaced apart circumferentially of the plate.

5. An improved centrifugal pump as in claim 4, wherein:

the number of injection ports is equal to the number of passages and the ports are equidistantly spaced from each other.

6. An improved centrifugal pump in claim 1, wherein:

the first fluid is heating oil, and the second fluid is water.

7. An improved centrifugal pump as in claim 1, wherein:

the first fluid is water vapor, and the second fluid is water.

8. An improved centrifugal pump as in claim 7, wherein:

the water vapor is evaporated salt water.

9. An improved centrifugal pump as in claim 1, which further comprises:

means for producing water vapor from a mass of water, the water vapor being the first fluid and water being the second fluid.

10. An improved centrifugal pump as in claim 9, wherein the mass of water is salt water.

11. An improved centrifugal pump as in claim 1, wherein the second fluid has a lower temperature than the first fluid.

12. An improved centrifugal pump for pumping a first fluid, the pump being of the type having a housing with an inlet and impeller which is rotatable within the housing adjacent to a stationary plate, the impeller and plate defining a space therebetween with which the inlet communicates, an outlet in the housing which is adjacent the periphery of the impeller and communicates with the space, the space being divided into a plurality of zig-zag pumping passages spaced circumferentially of the impeller and extending from the inlet to the periphery of the impeller, each passage having undulating sidewalls defined by complementary undulations formed in the facing surfaces of the plate and the impeller, each passage also having end walls defined by vanes mounted to the impeller which vanes extend outwardly from the inlet to the impeller periphery, generally conform to the undulations in the impeller, and are complementary to the undulations in the plate, wherein the improvement comprises:

a depression formed downstream of each crest in the undulating surfaces of both the plate and the impeller, whereby vortices are established and accommodated at or near the crests within the depressions.

13. An improved centrifugal pump as in claim 12, which further comprises:

smoothly rounded surfaces at the troughs opposite each peak, whereby vortices are established and accommodated at or near such troughs.

14. A centrifugal pump as in claim 13, wherein:

the vortices that are established at or near the peaks and the troughs rotate about an axis generally perpendicular to the flow of fluid through the passages and, where the vortices contact the fluid flow, they rotate in the same direction as such fluid flow.

15. A centrifugal pump as in claim 14, wherein the fluid of the vortices is a vapor.

16. A salt water desalinization system, comprising:

(a) a centrifugal pump for pumping a first fluid, said pump having a housing with an inlet and impeller which si rotatable within the housing adjacent to a stationary plate, said impeller and said plate defining a space therebetween with which the inlet communicates; an outlet int eh housing adjacent the periphery of the impeller, said outlet communicating with said space, said space being divided into a plurality of zig-zag pumping passages spaced circumferentially of the impeller and extending from the inlet to the periphery of the impeller, each passage having undulating side walls defined by complementary undulations formed in the facing surfaces of the plate and the impeller, each passage also having end walls defined by vanes mounted on the impeller, said vanes extending outwardly form the inlet to the impeller periphery, wherein said vanes generally conform to the undulations in the impeller and are complementary to the undulations in the plate; an injection port in the plate which communicates with said space downstream of the inlet at a point whereat there exists the lowest absolute pressure within the passages; and means for injecting through the port and into the passages a second fluid, wherein said second fluid has a lower temperature then said first fluid, whereby the vapor phase of the first fluid which is present in the passages because of the low absolute pressure is condensed and compressed upon contact with the second fluid and is thereafter centrifugally moved to the outlet;

(b) a closed reservoir for holding a mass of salt water;

(c) means for pumping sufficient salt water from the closed reservoir to produce a sufficiently low pressure above the salt water level to produce a mass of water vapor;

(d) means for selectively connecting the inlet of the pump to the water vapor mass for pumping thereof out of the reservoir; and (e) means for supplying-water to the injecting means, whereby the condensed salt-free water vapor is moved to the outlet.

17. A system as in claim 16, which further comprises the supplying means comprises a path form the outlet to the injecting means.

18. A system for degassifying a liquid having gas dissolved therein, comprising:

(a) a centrifugal pump for pumping a first fluid, said pump having a housing with an inlet and impeller which is rotatable within the housing adjacent to a stationary plate, said impeller and said plate defining a space therebetween with which the inlet communicates; an outlet in the housing adjacent to the periphery of the impeller, said outlet communicating with said space, said space being divided into a plurality of zig-zag pumping passages spaced circumferentially of the impeller and extending from the inlet to the periphery of the impeller, each passage having undulating side walls defined by complementary undulations formed in the facing surfaces of the plate and the impeller, each passage also having end walls defined by vanes mounted to the impeller, said vanes extending outwardly form the inlet to the impeller periphery, wherein said vanes generally conform to the undulations in the impeller and are complementary to the undulations in the plate; an injection port in the plate which communicates with said space downstream of the inlet at a point whereat there exists the lowest absolute pressure within the passages; and means for injecting through the port and into the passages a second fluid, wherein said second fluid has a lower temperature than said first fluid, whereby the vapor phase of the first fluid which is present in the passages because of the low absolute pressure is condensed and compressed upon contact with the second fluid and is thereafter centrifugally moved to the outlet;

(b) a conduit connecting a source of the liquid to the inlet;

(c) a trap in the conduit for retaining gases extracted from the liquid by low absolute pressure applied to the conduit by the inlet; and (d) means for connecting the trap to the injector to mix the extracted gases with the liquid within the pump, with the degasified liquid-gas mixture exiting the outlet, whereafter the gases dissipate into the atmosphere.

* * * * *